US005088213A

United States Patent [19]

Raimondo et al.

[11] Patent Number: 5,088,213

[45] Date of Patent: Feb. 18, 1992

[54] FRONT HOE ATTACHMENT FOR LOADER

[76] Inventors: Anthony J. Raimondo; Madeline D. Raimondo, both of 117 Chandler Mill Rd., Kennett Square, Pa. 19348

[21] Appl. No.: 656,436

[22] Filed: Feb. 19, 1991

[51] Int. Cl.[5] ..... E02F 5/02

[52] U.S. Cl. ..... 37/103; 37/DIG. 3; 37/117.5; 172/826; 414/715; 414/718

[58] Field of Search ..... 37/103, 117.5, DIG. 3, 37/DIG. 12; 414/697, 715, 718; 172/826

[56] References Cited

U.S. PATENT DOCUMENTS

| | | | |
|---|---|---|---|
| 2,808,666 | 10/1957 | Schneckloth | 172/826 |
| 3,208,611 | 9/1965 | Robnett | 37/103 |
| 4,142,308 | 3/1979 | Brandtjen | 37/103 |
| 4,854,811 | 8/1989 | Veys | 37/117.5 X |
| 4,884,940 | 12/1989 | Steinkamp et al. | 414/715 |
| 4,964,778 | 10/1990 | Muto et al. | 414/718 X |

FOREIGN PATENT DOCUMENTS

| | | | |
|---|---|---|---|
| 763273 | 7/1967 | Canada | 37/103 |
| 1080484 | 4/1960 | Fed. Rep. of Germany | 37/DIG. 12 |

*Primary Examiner*—Randolph A. Reese
*Assistant Examiner*—Arlen L. Olsen
*Attorney, Agent, or Firm*—Connolly & Hutz

[57] ABSTRACT

A front hoe attachment for a loader includes a connecting frame which is capable of being attached to the manipulating mechanism at the front end of a loader such as a tractor. The connecting frame has a bucket secured to its outer end so that the bucket can be manipulated by use of the loader to perform various operations such as digging operations.

7 Claims, 2 Drawing Sheets

FRONT HOE ATTACHMENT FOR LOADER

BACKGROUND OF INVENTION

There is a need in various fields, such as construction, landscaping and farming to provide a digging device capable of digging ditches or holes of significant lengths and/or depths. Preferably such device should be mechanically operated so as to avoid the necessity for manual labor in the digging operation. Conventionally such digging is done by a backhoe which gets its name from the fact that it is mounted to the back of the vehicle such as a tractor. Conventional backhoes are quite complicated and expensive as well as cumbersome to use. In general, the expense for such a conventional backhoe tractor is so prohibitive that it does not have widespread appeal to farmers or landscapers who might only occasionally need the digging operation. For such users, when the occasional need arises, backhoes are rented or owners of backhoes are contracted to do the specialized digging operation.

SUMMARY OF INVENTION

An object of this invention is to provide a front hoe attachment to a loader such as a tractor which overcomes the deficiencies of conventional backhoe tractors.

A further object of this invention is to provide such a front hoe attachment that could be manufactured and sold at greatly reduced cost compared to the conventional backhoe.

A still further object of this invention is to provide a front hoe attachment which may be used on a tractor in place of conventional attachments presently being used.

In accordance with this invention, the front hoe attachment would be used on a loader such a tractor having a manipulating assembly which is capable of elevation and extension. Such manipulating assemblies presently exist on tractors but in conjunction with other tools, such as forks. The present invention involves the detachment of the conventional tool, such as the fork, and its temporary replacement by a front hoe. The front hoe would be in the form of a connecting frame which would be detachably secured to the manipulating assembly with a bucket mounted at the free end of the connecting frame so that the bucket may be manipulated during use of the tractor. When a particular digging operation is completed the front hoe would be detached and replaced by the conventional tools that are customarily used at the front end of such tractors.

In one practice of this invention, the connecting frame includes extendable links which provide an adjustable reach for the bucket. In a more simplified embodiment the connecting frame would be of fixed construction.

THE DRAWINGS

DETAILED DESCRIPTION

Figure 2:
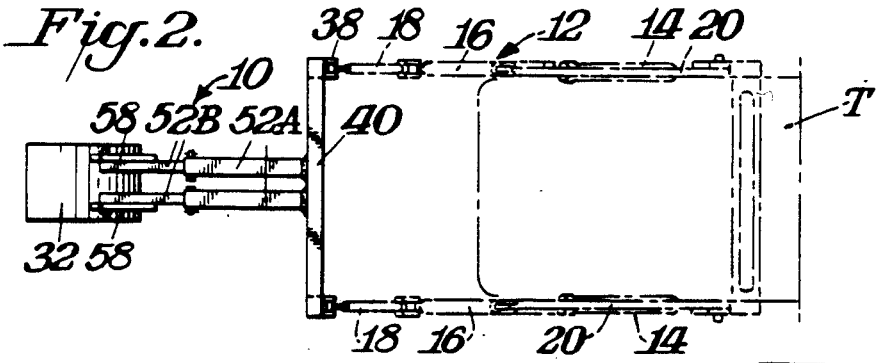
FIG. 2 is a top plan view of the front hoe attachment shown in FIG. 1.

FIGS. 1–5 illustrate a front hoe attachment 10 in accordance with this invention. As shown therein, front hoe attachment 10 would be mounted to the front end of a conventional tractor T which is shown in phantom in FIGS. 1 and 4. Tractor T would include a conventional manipulating assembly 12 having piston cylinder arrangements 14, 16 and 18 which are operated by the driver of tractor T to elevate the manipulating frame 20 by extension of piston cylinder arrangement 14 and then to rotate link 22 about pivot point 24 by means of piston cylinder arrangement 16. Piston cylinder arrangement 18 is connected at pivot point 26 to link 22 for extension or retraction of a suitable tool mounted at the remote end of frame member 28 and piston cylinder assembly 18 in a known manner.

The present invention involves the recognition that such tractors T include such a manipulating assembly used for manipulating tools such as forks. In accordance with the invention, such conventional tools would be detached from their connection to the manipulating assembly 12 and would be replaced by front hoe attachment 10. Front hoe attachment 10 may take any suitable form. In general, front hoe attachment 10 includes a connecting frame 30 having a bucket 32 secured at its remote end. The front end 34 of bucket 32 has digging teeth 36 which are suitably constructed for digging ditches, trenches or other forms of holes.

Front hoe attachment 10 may be secured to frame member 28 and piston cylinder assembly 18 in any suitable manner. For example, the attachment could be by means of ears or flanges 38 which extend perpendicularly from links 40,42 with pins or other suitable fasteners making the actual detachable connection.

Figure 1:
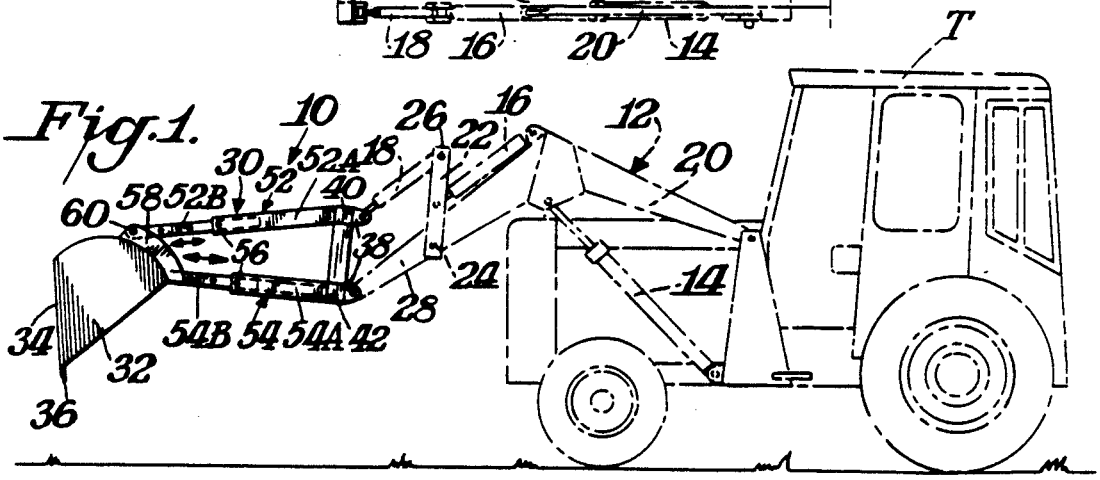
FIG. 1 is a side elevational view of a front hoe attachment to a tractor in accordance with this invention.
Figure 3:
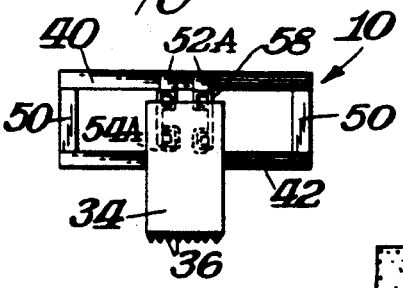
FIG. 3 is a front elevational view of the front hoe attachment shown in FIGS. 1–2.
Figure 5:
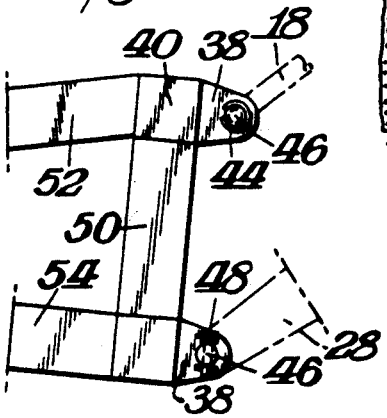
FIG. 5 is an enlarged elevational view of the detachable connection of the front hoe attachment shown in FIGS. 1–4.

FIGS. 1–2 and 5 illustrate a practice of the invention which is particularly suitable for providing a quick and convenient means of attachment and detachment of front hoe 10. As shown therein each end of horizontal parallel end links 40 and 42 includes a pair of ears or flanges 38 which form a yoke into which the end of piston cylinder assembly 18 or frame member 28, as the case may be, is inserted. The physical connection is effected by a pin being inserted through each pair of ears 38 and the piston cylinder assembly 18 or frame 28 as the case may be. A temporary locking is effected in any suitable manner. For example, FIG. 5 illustrates two possible manners of detachably locking the front hoe to the manipulating assembly. In this respect, FIG. 5 illustrates the use of a split ring 44 extending around a suitable groove in locking pin 46 to detachably lock the piston cylinder assembly 18 to front hoe 10. The lower portion of FIG. 5 illustrates an alternative wherein a pin 48 is inserted through locking pin 46 on each outer side of the yoke to detachably lock frame member 28 to front hoe 10.

The connecting frame 30 of front hoe 10 may include as a rear connecting assembly in addition to top and bottom horizontal links 40,42 vertical links 50. The various links may take any suitable form, such as being made of steel tubing. In the central portion of connecting frame 30, a pair of side links 52,54 are provided which extend from the rear of connecting frame 30 at its connection to manipulating assembly 12 to the front of connecting frame 30 where it is connected to bucket 32. Bucket 32 may include any suitable means of connection to the side links 52,54.

Figure 4:
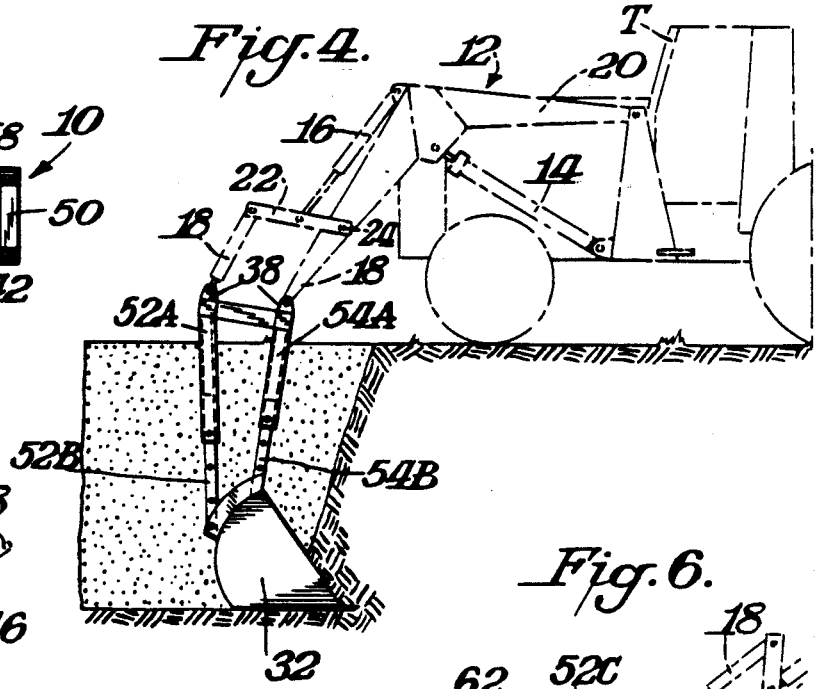
FIG. 4 is a view similar to FIG. 1 in the digging phase of operation.

FIGS. 1 and 4 illustrate a particularly advantageous form of this invention wherein the side links 52,54 are adjustable in length. This can be achieved in any suitable manner, such as forming each side link with a fixed member 52A,54A and a sliding member 52B,54B. Sliding member 52B or 54B could, for example, be telescoped into its corresponding tubular link 52A or 54A and locked in place in any suitable manner, such as by a bolt and nut fastener 56 which would be inserted into selected aligned openings, as illustrated. In the preferred . practice of the invention the length adjustment is achieved by telescoping an inner tube into an outer tube. The invention, however, may be practiced in other manners such as by having flat side by side links rather than tubular members.

In the adjustable embodiment illustrated in FIGS. 1 and 4 bucket 32 includes a fixed arcuate flange 58 which may be used as a means for a detachable connection to connecting frame 30, such as by the provision of a detachable fastener 60 at the end of each link 52,54. This permits the bucket 32 and frame 30 to be detached for replacement or repair of portions of the bucket or frame.

Figure 7:
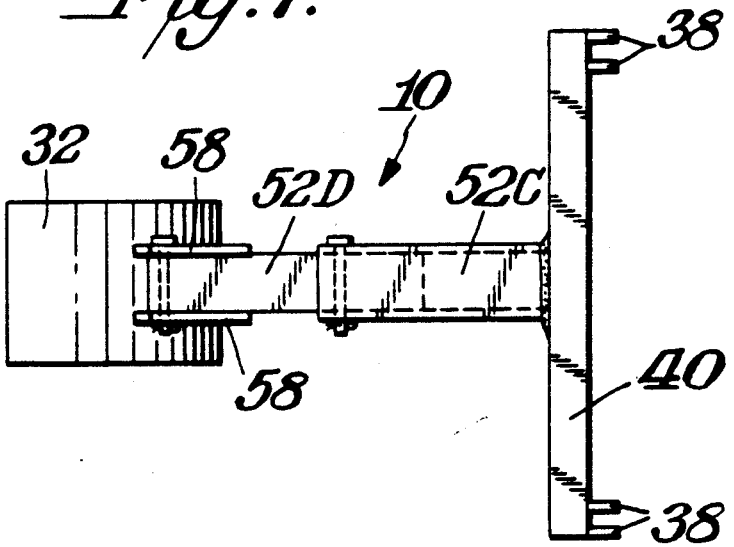
FIG. 7 is a top plan view of a further embodiment of this invention.

FIG. 2 illustrates a possible practice of the invention wherein the front hoe attachment includes spaced sets of links or arms 52A and 52B and links 54A and 54B connecting bucket 32 to link 40. The preferred practice of the invention, however, is illustrated in FIG. 7 wherein a single set of telescoping arms 52C and 52D connect bucket 32 to link 40 instead of having a pair of arms such as arms 52A,52A and 52B,52B. Similarly, only one set of lower arms or links would be used instead of the pairs 54A,54A and 54B,54B. The single set of arms has a number of distinct advantages over the double arm arrangement of FIG. 2. These advantages include greater strength and less cost.

Figure 6:
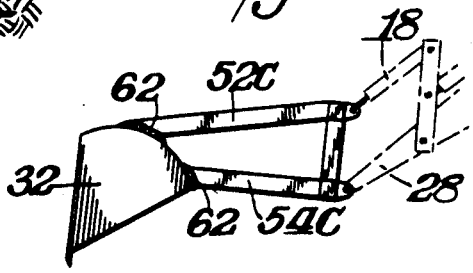
FIG. 6 is a front elevational view of a modified form of front hoe attachment in accordance with this invention.

FIG. 6 illustrates a more simplified form of this invention wherein each side link 52C and 54C is non-adjustable. In this variation each link 52C and 54C may be connected directly to bucket 32 in any suitable manner, such as by welding as indicated by the reference numeral 62.

FIGS. 1 and 4 illustrate front hoe 10 in different phases of operation. Front hoe 10 is in its stored or transportable condition wherein bucket 32 is elevated above the ground. When it is desired to use front hoe 10 for digging the various components would move from the condition of FIG. 1 immediately before digging and assume a condition more like that shown in FIG. 4 during digging. In this respect, manipulating assembly 12 would be operated from within tractor T so as to extend the piston from piston cylinder assembly 16 to pivot link 22 in a counter-clockwise direction which in turn moves connecting frame 30 and bucket 32 forwardly. Extension of the pistons from piston cylinder assembly 18 results in rotating bucket 32 in a counter-clockwise direction so as to effect a digging action. When the bucket has dug into the earth the operation of the various piston cylinder assemblies is reversed to elevate the bucket so that it can be unloaded and the digging operation is repeated until a hole of desired size and shape is achieved. For example, with front hoe 10 it is possible when using the stationary or non-adjustable version of FIG. 6 to dig to a depth of about 54 inches. When the adjustable version of FIGS. 1 and 4 is used it is possible to dig to a depth of approximately 72 inches. The adjustable version is preferred since it is more powerful at shorter reaches.

As can be appreciated front hoe 10 provides an arrangement which makes it possible for construction workers or landscapers to own their own digging attachment which is readily available for periodic digging operations and such attachment would be economical to use and maintain since it takes advantage of the manipulating assembly that is already present with conventional tractors when used for other types of tools. The ready attachability and detachability of front hoe 10 enhances its convenience of use and permits easy storage and repair should such be necessary.

What is claimed is:

1. In combination therewith, a loader having a front and a back, a manipulating assembly having a back end fixedly connected to said front of said loader and a front end remote from said back end, said front end of said manipulating assembly terminating in a pair of parallel piston cylinder assemblies having forward and rearward piston cylinders and in a frame member mounted below said forward and rearward piston cylinders, said front end of said manipulating assembly being capable of selective extension/retraction and elevation/lowering with respect to said front of said loader, a front hoe, detachable connecting means detachably mounting said front hoe to said front end of said manipulating assembly, said front hoe comprising a connecting frame and a bucket, said connecting frame comprising a rear connecting assembly and a side link means, said detachable connecting means comprising a plurality of connecting members on said rear connecting assembly and disposed against said piston cylinder assemblies and against said frame member and fasteners detachably connecting said respective connecting members to their juxtaposed forward piston cylinder and said frame member, said side link means being secured to and extending outwardly from said rear connecting assembly and being connected to said bucket, a plurality of digging teeth on said bucket, and said rear connecting assembly and said side link means and said bucket being figidly connected together whereby said manipulating assembly comprises the sole means for the extension/retraction and elevation/lowering and pivoting of said bucket during the digging operation of said bucket.

2. The combination of claim 1 wherein said rear connecting assembly comprises spaced horizontal links interconnected by vertical links.

3. The combination of claim 2 wherein said connecting members comprise yokes extending outwardly from said links.

4. The combination of claim 1 wherein said side link means is longitudinally extendable.

5. The combination of claim 4 wherein said side link means comprises sets of telescopically arranged side link members.

6. The combination of claim 5 wherein one of said sets of side link members is pivotally connected to said bucket.

7. The combination of claim 1 wherein said loader is a tractor.

* * * * *